United States Patent [19]

Armstrong

[11] Patent Number: 4,721,244

[45] Date of Patent: Jan. 26, 1988

[54] NEWSPAPER BOX SIGNAL DEVICE

[76] Inventor: Rodney D. Armstrong, 15850 Mennel, Grafton, Ohio 44044

[21] Appl. No.: 47,618

[22] Filed: May 7, 1987

[51] Int. Cl.[4] ..... B65D 91/00

[52] U.S. Cl. ..... 232/34; 232/1 C

[58] Field of Search ..... 232/1 C, 34, 43.4

[56] References Cited

U.S. PATENT DOCUMENTS

| | | | |
|---|---|---|---|
| 2,553,164 | 5/1951 | Bishop | 232/34 |
| 3,386,649 | 6/1968 | Joyce | 232/34 |
| 4,007,870 | 2/1977 | Hankis | 232/1 C X |
| 4,412,646 | 11/1983 | Hollenbach | 232/34 |

*Primary Examiner*—Robert W. Gibson, Jr.

*Attorney, Agent, or Firm*—Donald A. Bergquist

[57] ABSTRACT

This invention relates to a device for signaling the delivery of mail, newspapers, or parcels in an enclosed receptacle that is open on at least one end, that end being the receiving opening for such deliveries, there being no closure for said opening. The principal application is for the commonly-used roadside newspaper delivery tube, the opening of which generally faces away from the residence so the presence of the newspaper is obscured from view by the resident for whom the newspaper is intended. The invention comprises a trigger element that blocks a portion of the delivery opening of the receptacle and a flag element that signals the delivery, these elements operatively slidably engaging one another.

10 Claims, 5 Drawing Figures

NEWSPAPER BOX SIGNAL DEVICE

INTRODUCTION

This invention relates to apparatus for signaling the delivery of mail, newspapers, or parcels in an enclosed receptacle that is open on at least one end, that end being the receiving opening for such deliveries, there being no closure for said opening. The principal application is for the commonly-used roadside newspaper delivery tube, the opening of which generally faces away from the residence so the presence of the newspaper is obscured from viewing by the resident for whom the newspaper is intended. The invention comprises a trigger element that blocks a portion of the delivery opening of the receptacle and a flag element that signals the delivery, wherein these elements operatively slideably engage one another.

SUMMARY OF THE INVENTION

It is observed that in suburban and especially in rural areas, newspaper delivery is by motor routes wherein the delivery agent inserts the newspaper into metal or plastic tubes, boxes, or other receptacles that are generally open at the end facing the roadway. In most instances in rural areas, the residence is a decided distance from the roadway, making it desirable and useful to have some sort of signaling device on the receptacle to signal the presence of the newspaper or other similarly delivered article. A similar problem has long existed for mail delivery, and it has been addressed in a number of patented and unpatented apparatus, most of which rely upon the delivery agent setting the signal device or which rely upon the action of the delviery agent's opening of the mail box door to trigger the signal. Numerous such signals are totally nechanical and some are electrical in nature.

In searching the market and the patent literature, however, applicant has seen no apparatus specifically designed for, nor in his mind suitable for, application to the newspaper tube. He believes there is a longfelt but unfulfilled need in this area of technology.

It is the object of this invention, therefore, to provide a simple and effective mechanical signaling device for use on a delivery receptacle that is open on at least one end, said open end being the opening for receiving deliveries, and having no closure for said open end.

It is a further object of this invention that said signaling device require no action by the delivery agent other than the insertion of the delivered article, which insertion necessarily trips a trigger element that is pivotally connected to the enclosing wall of said receptacle adjacent said delivery opening.

It is a further object of this invention that a signal flag element be cooperatively interactive with said trigger element to move from an untripped position to a tripped position that may be visible from the residence after said trigger element has been tripped by the insertion of the delivered article.

It is a further object of this invention that either or both cooperating elements operate on pivots that may be spring biased.

It is a further object of this invention that the cooperating elements operate on pivot axes that are mutually parallel.

It is a further object of this invention tht either or both cooperating elements operate on pivots such that their desired tripped or untripped positions are maintained by the weight distribution of each respective element or by weights added thereto.

It is a further object of this invention that means are provided for retrofitting pre-existing delivery receptacles with the signaling apparatus.

These and other objects of this invention will become apparent from the following description of the invention.

BRIEF DESCRIPTION OF THE DRAWINGS

This invention will be most clearly understood by reference to the several drawings presented as figures, in which similar numbers refer to the same parts throughout the description.

DETAILED DESCRIPTION OF THE INVENTION

The present invention is a signaling device that indicates the arrival of an article in a receptacle such as a delivery box generally of the type used for receiving delivery of newspapers on delivery routes serviced by carriers in motor vehicles. Such receptacles may be described as of generally cylindrical shape, with one end open with no closure provided for the open end, through which open end delivery is made.

In referrring to a cylindrical shape, we mean that the shape may be generated by the motion of a substantially straight line segment following a curved path while remaining substantially parallel to a reference straight line. This description comes from a mathematical definition of a generic cylinder, of which the commonly considered right circular cylinder is a special case. This definition is meant to include delivery receptacles that are in the shape of right circular cylinders, wherein the curved path followed is a circle and the line segment is kept at right angles to the plane of the circle. It is also meant to include the more modern shape used for newspaper delivery boxes wherein the general shape is a four-sided generally rectangular box with rounded corners, wherein the walls thereof may taper slightly, and wherein the curved path followed is a rectangle with rounded corners and the line segment is kept only generally parallel to the said reference straight line and only generally perpendicular to the plane of the rectangle. In each case, the cylinder may be said to have a major axis that is parallel to or generally parallel to the said reference straight line.

Figure 1:
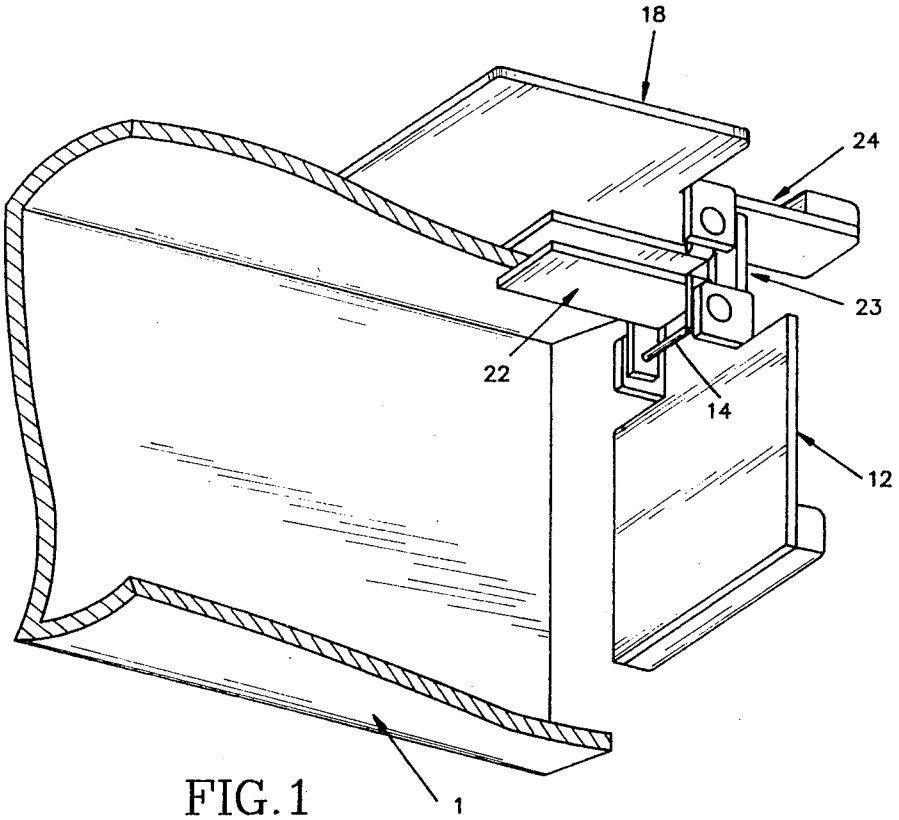
FIG. 1 shows a perspective view of the invention signal device mounted on a delivery receptacle.

FIG. 1 shows a newspaper delivery box 1 fitted with a signal device of the present invention. The trigger element 12, which pivots on a first pivot axis 14, blocks a portion of the delivery opening of the box 1 so that for a newspaper or other article to be placed in the box, the trigger element 12 must be pushed. Also visible in FIG. 1 is a signal flag element 18, which pivots on a second axis 20.

Figure 2:
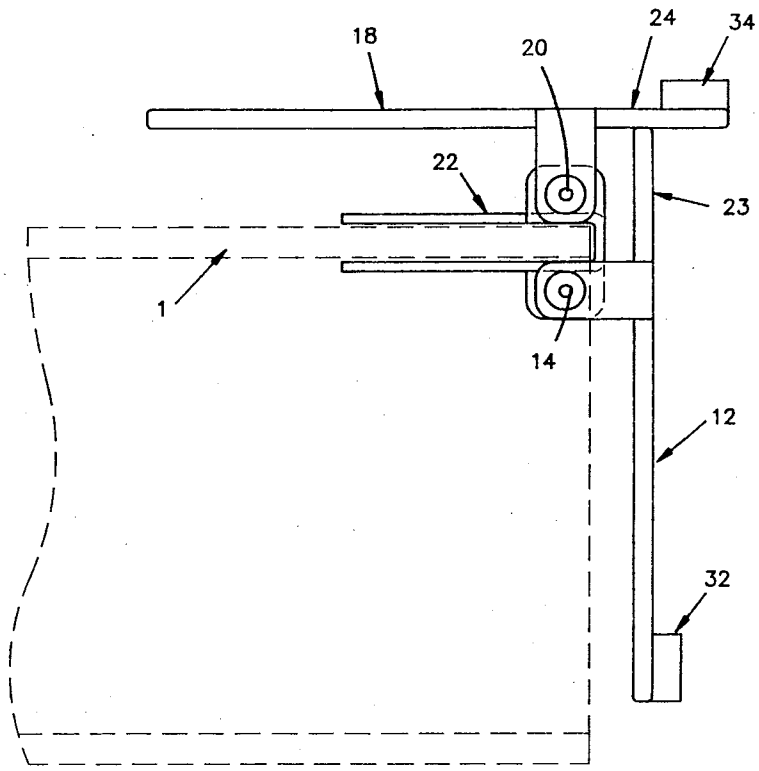
FIG. 2 shows a side view of the invention in the untripped position.
Figure 3:
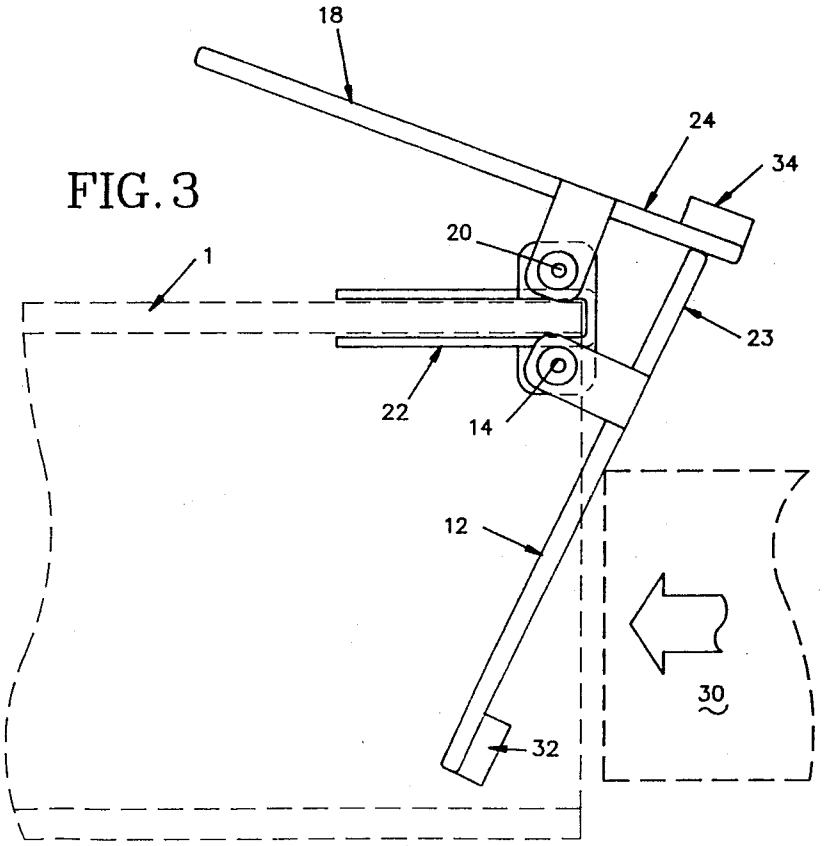
FIG. 3 shows a similar side view of the invention in an intermediate position as a parcel is placed into the delivery receptacle.
Figure 4:
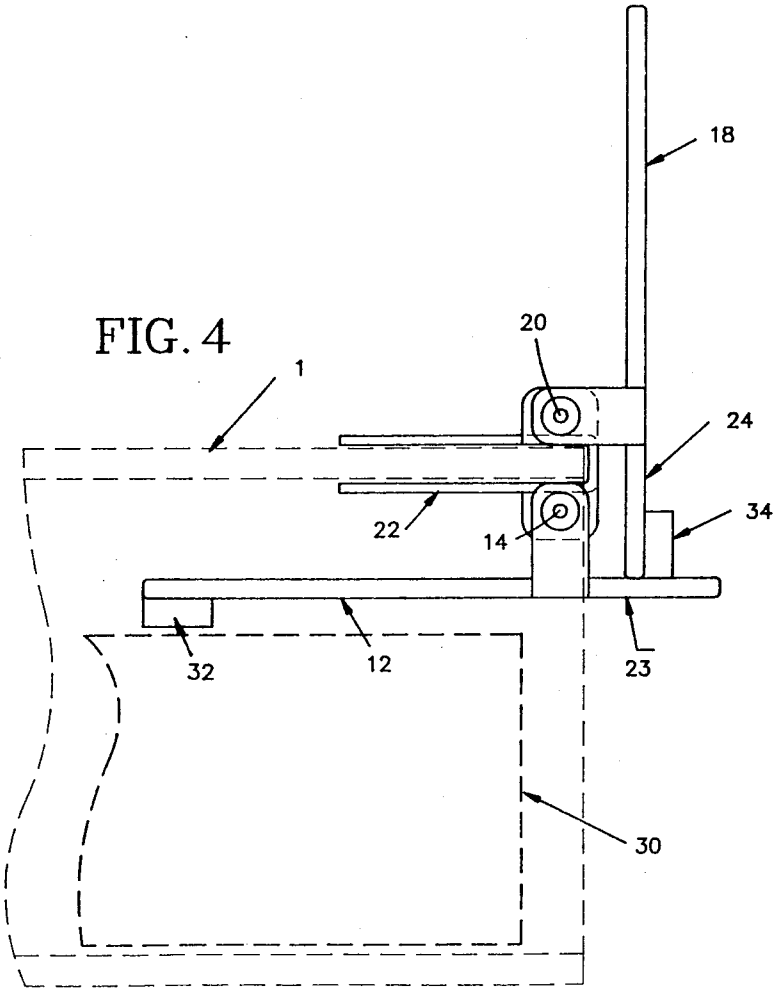
FIG. 4 shows a similar side view of the invention in the tripped position.

To understand the workings of the signal device, the reader is referred to FIGS. 2 through 4. In FIG. 2, the trigger element 12 is shown in its untripped position and the signal flag element 18 is shown in its untripped position. The first and second pivot axes are located at 14 and 20, respectively. These pivot axes may be created by using a pair of mating elements as used in a hinge, one element of which is fixedly attached to the wall of the receptacle and one of which is fixedly attached to the respective trigger or signal flag element, which hinge-like elements pivot with respect to one anothre on a hinge pin. In these figures, the signal device is shown as an attachment to a pre-existing delivery box 1, as the hinge-like element attached to the wall is not attached directly to the wall, but to a fitting 22 that may be removably attached to the wall. The purpose is to show a device for retrofit on pre-exiting delivery receptacles as well as a device that may be removed for use elsewhere. It is clear that the wall-attached hinge-like element could be made as an integral part of the box 1 during manufacture thereof.

As a matter of fact, it is not inconceivable that the entire receptacle with the signal device as an integral part thereof could be molded as one piece by using thin webs of the molding plastic to create what is often called a "living hinge" in place of the pivot elements described herein. Such a "living hinge" would perform the same function as the pivots of the present application. Also, an attachable signal device as shown in the drawings might similarly be molded as one piece by such a method for attachment to pre-existing delivery receptacles as a retrofit device.

Of special interest in understanding this invention are the substantially planar extensions of the principal elements 12 and 18, which extensions are labeled 23 and 24, respectively. These extensions are preferably offset from the respective first and second pivot axes and their effective length must be greater than the distance between the first and second pivot axes. In practice, the effective length of each extension is made approximately equal to the sum of the distance between the first and second pivot axes plus the distance its opposite cooperating extension is offset from its respective pivot axis. For example, the effective length of extension 23 has been made to be approximately equal to the distance between the first and second pivot axes 14 and 20 plus the distance extension 24 is offset from pivot axis 20.

FIG. 3 illustrates the trigger element and the signal flag element in an intermediate transition position during the insertion of a parcel 30 in to the delivery receptacle. This figure is presented to show clearly the manner in which the extensions 23 and 24 interact in transition. It should first be pointed out that a biasing means is present to urge the signal flag element 18 toward its tripped position, which position is that shown in FIG. 4. A second biasing means is present to urge the trigger element 12 toward its untripped position, which position is that shown in FIG. 2. As the parcel 30 is inserted in the direction indicated by the large arrow, the trigger 12 is pushed inward against the force exerted by its biasing means. This motion causes the proximal edge of the trigger's extension 23 to slide along extension 14 away from pivot 20; it will eventually clear the end of extension 24. Then the proximal edge of extension 24 will begin sliding on extension 23 toward pivot 14, being driven by the force of the signal flag element's biasing means, thereby raising signal flag element 18.

Figure 5:
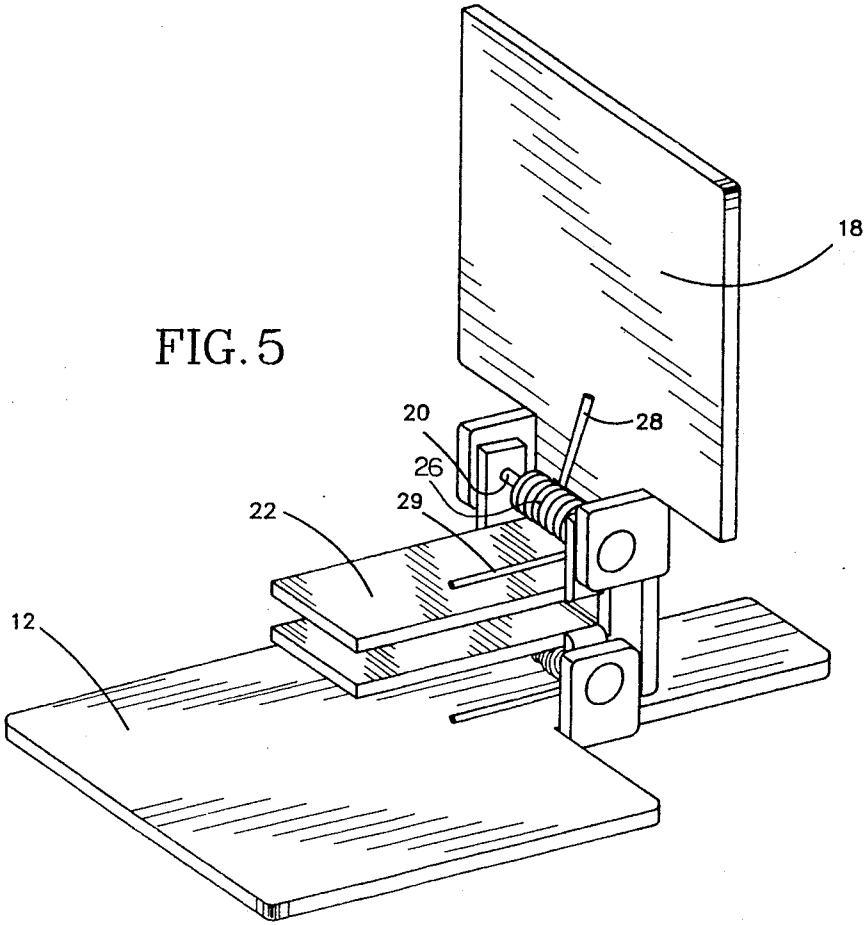
FIG. 5 shows a view of one means of providing a biasing means for the hinge elements of the invention.

The biasing means used to urge the trigger element 12 and the signal flag element 18 toward their untripped and tripped positions, respectively, may comprise spring means generally located in the region of the pivot axes, such as a coil spring storing torque to bias the said element as is shown in FIG. 5. The coil spring 26 has entensions 28 and 29 on each end that transfer the torque stored in the spring to the signal flag element 18 to urge it to the tripped position shown in FIG. 5. Such a biasing means would function regardless of the physical orientation of the signaling apparatus, allowing the apparatus to be mounted on any side of the receptacle.

Alternatively, where the first and second pivot axes are perpendicular to the direction of the force of gravity, the biasing means may be the force of gravity operating on the weight distribution of the respective moving parts of the apparatus (i.e., the trigger element and the signal flag element). This weight distribution may be inherent to the shape and thickness of each moving element or it may be effected by the addition of weights to the moving parts as at 32 and 34. The details of construction would vary whether the apparatus were mounted on the top wall of the receptacle or the bottom wall of the receptacle, but in all cases, the respective elements are biased toward their tripped and untripped positions as previously stated.

While applicant has described two different means each biasing one of the working elements, it is equally possible to use a single biasing means to bias both the signal flag element and the trigger element. For example, a single strip of spring steel running from the bottom surface of signal flag element 18 to the back surface of trigger element 12 will bias both elements appropriately. Such improvement should be considered within the scope of this invention.

Having thus described his invention in sufficient detail for one skilled in the art to reproduce his invention and obtain results similar to his, applicant wishes to include within the scope of his invention such articles that would be immediately obvious from the descriptions contained herein; such scope shall be limited only be the scope of the claims appended hereto.

I claim:

1. In an apparatus for signaling the delivery of articles, such as mail, newspapers, or parcels, for examples, in a receptacle having enclosing walls forming a substantially cylindrical shaped elongated enclosure having a major axis, which receptacle is open at at least one end, said open end being the opening for receiving deliveries, and having no closure for said open end, which apparatus comprises:

a. a trigger element that is pivotally connected to the enclosing wall of said receptacle adjacent said open end, which trigger element in an untripped position blocks at least a portion of said open end so that placing said article into the receptacle through said open end requires pushing said trigger element out of the way to a tripped position in which said trigger element is mainly within said receptacle and is substantially parallel to the major axis of said enclosure and adjacent a wall of said enclosure, thus leaving the opening free of significant obstruction by said trigger element;

b. a signal flag element that is pivotally connected to the said enclosing wall of said receptacle, which flag element is mainly outside of said receptacle, and which flag element operatively connects with said trigger element such that when said trigger element is in an untripped position, said flag element is substantially parallel to the outer surface of said enclosing wall, which position is the untripped position of said flag element, and when said trigger element is in a tripped position, said flag element is substantially perpendicular to said enclosing wall, which position is the tripped position of said flag element;

c. an operative connection between said trigger element and said signal flag element comprising planar extensions of the proximal end of each said element, the planar extension of te trigger element lies in a plane which is substantially parallel to and which may be coplanar with the pivot axis of said trigger element, and the planar extension of the signal flag element lies in a plane which is substantially parallel to and which may be coplanar with the pivot axis of said flag element, which two pivot axes are substantially parallel but not colinear, which planar extensions are each longer than the distance between said pivot axes, and which planar extensions slidably engage one another directly and through no other interconnecting means as each said element pivots on its respective pivot axis.

2. The apparatus of claim 1 wherein said trigger element is substantially planar.

3. The apparatus of claim 1 wherein said trigger element blocks a substantial portion of said open end, said portion ranging from 20% of the area of said open end to 95% of the area of said open end.

4. The apparatus of claim 1 wherein the pivot of said trigger element includes a spring biasing element that encourages said trigger element to remain in its untripped position.

5. The apparatus of claim 1 wherein the pivot of said signal flag element includes a spring biasing element that encourages said signal flag element to remain in its tripped position.

6. The apparatus of claim 1 wherein the weight distribution of said trigger element is such to encourage said trigger element to remain in said untripped position due to the force of gravity thereon.

7. The apparatus of claim 1 wherein the weight distribution of said signal flag element is such to encourage said signal flag element to remain in said tripped position due to the force of gravity thereon.

8. The apparatus of claim 6 wherein said weight distribution is effected by means of the application of at least one external weight to said trigger element.

9. The apparatus of claim 7 wherein said weight distribution is effected by means of the application of at least one external weight to said signal flag element.

10. The apparatus of claim 1 wherein the major elements of said signaling apparatus, defined as said trigger element and said signal flag element, are indirectly attached by said pivots to said wall of said delivery receptacle through intermediate means attached to said receptacle, said means providing cooperating pivot elements necessary for retrofitting existing delivery receptacles with said signaling apparatus, which intermediate means may be removably attached to said delivery receptacle.

* * * * *